US006128363A

United States Patent [19]

Shoki et al.

[11] Patent Number: 6,128,363

[45] Date of Patent: Oct. 3, 2000

[54] X-RAY MASK BLANK, X-RAY MASK, AND PATTERN TRANSFER METHOD

[75] Inventors: Tsutomu Shoki, Hachioji; Takamitsu Kawahara, Kawasaki, both of Japan

[73] Assignee: Hoya Corporation, Tokyo, Japan

[21] Appl. No.: 08/979,839

[22] Filed: Nov. 26, 1997

[30] Foreign Application Priority Data

Nov. 29, 1996 [JP] Japan ..... 8-334511

[51] Int. Cl.[7] ..... G21K 5/00

[52] U.S. Cl. ..... 378/35; 378/210

[58] Field of Search ..... 378/35

[56] References Cited

U.S. PATENT DOCUMENTS 5,005,075 4/1991 Kobayashi ..... 378/35

OTHER PUBLICATIONS

T. Shoki et al., SPIE 1924,450, 1993, Electron–Beam, X–Ray, and Ion–Beam Submicrometer Lithographies for Manufacturing III.

*Primary Examiner*—Craig E. Church
*Attorney, Agent, or Firm*—Perman & Green, LLP

[57] ABSTRACT

An X-ray mask blank makes it possible to manufacture an X-ray mask which has an extremely low stress, thus providing an extremely high positional accuracy. In the X-ray mask blank, an X-ray transparent film is formed on a substrate, and an X-ray absorber film is formed on the X-ray transparent film. The top and/or the bottom of the X-ray absorber film is provided with a film in which the product of the film stress and the film thickness thereof lies in the range of 0 to $\pm 1\times 10^4$ dyn/cm.

13 Claims, 5 Drawing Sheets

X-RAY MASK BLANK, X-RAY MASK, AND PATTERN TRANSFER METHOD

REFERENCE TO RELATED APPLICATION

This application claims the priority right under 35 U.S.C. 119 of Japanese Patent Application No. Hei 08-334511 filed on Nov. 29, 1996, the entire disclosure of which is incorporated herein by reference.

BACKGROUND OF THE INVENTION

1. Field of the Invention

The present invention relates to an X-ray mask blank, an X-ray mask, and a pattern transfer method used for X-ray lithography.

2. Description of the Related Art

In the semiconductor industry, as a technique for transferring a fine pattern to form an integrated circuit composed of a fine pattern on a silicon substrate or the like, a photolithography method has been hitherto used in which the fine pattern is transferred using visible light or ultraviolet light.

In recent years, however, with the advances of the semiconductor technology, the integration scale of super-LSIs or other semiconductor devices is growing higher. This has led to a demand for a high-precision fine pattern transfer technique which breaks through the limitations of the transfer technique that depends on visible light or ultraviolet light conventionally used in the photolithography method.

To implement the transfer of such a fine pattern, an X-ray lithography method using X-rays shorter in wavelength than visible light or ultraviolet light is being developed.

The configuration of an X-ray mask employed for the X-ray lithography is shown in FIG. 1.

As shown in the drawing, an X-ray mask 1 is constituted by an X-ray transparent film or membrane 12, through which X-rays are transmitted, and an X-ray absorber pattern 13*a* for absorbing X-rays; these components are supported by a support substrate or frame 11*a* made of silicon.

FIG. 2 shows the configuration of an X-ray mask blank. An X-ray mask blank 2 is composed of the X-ray transparent film 12 and an X-ray absorber film 13 formed on a silicon substrate 11.

For the X-ray transparent film, silicon carbide having high Young's modulus and exhibiting high resistance to the exposure to X-rays is commonly used. For the X-ray absorber film, an amorphous material containing Ta which is highly resistant to the exposure of X-rays is frequently used.

The X-ray mask 1 is fabricated from the X-ray mask blank 2 by, for example, the following process.

A resist film on which a desired pattern has been formed is placed on the X-ray mask blank 2, then dry etching is performed using the resist pattern as the mask to form an X-ray absorber pattern. After that, the film of the area which corresponds to a window area (the recessed portion on the back surface) of an X-ray transparent film formed on the back surface is removed by a reactive ion etching (RIE) process which employs $CF_4$ as the etching gas. The remaining film is used as the mask to etch the back surface of the silicon substrate by using an etchant composed of a mixture of hydrofluoric acid and nitric acid.

In the process mentioned above, an electron beam (EB) resist is usually used as the resist; the pattern is formed by exposure using an EB writing process.

The EB resist, however, does not have sufficiently high resistance to dry etching, which is quick etching, used for processing the X-ray absorber film. Hence, if the X-ray absorber film is directly etched using the resist pattern as the mask, then the resist pattern is lost by etching before the formation of the pattern on the X-ray absorber film is completed, making it impossible to obtain the desired X-ray absorber pattern.

As a general solution to the foregoing problem, a film known as an etching mask layer having a high etching selective ratio for the X-ray absorber film is inserted between the X-ray absorber film and the resist in order to form the X-ray absorber film pattern.

In such a case, to prevent a difference in size from being produced between the resist pattern and the X-ray absorber pattern, which difference is referred to as "pattern conversion difference," it is necessary to make the etching mask layer as thin as possible. For this reason, when patterning the X-ray absorber film, it is required to set the speed for etching the etching mask layer sufficiently low (a high etching selective ratio) in relation to the speed for etching the X-ray absorber film.

In addition, the X-ray absorber film must be etched for a slightly longer than a preset time, which is known as "over-etching" so as to ensure a uniform pattern configuration in a wafer surface without leaving partially unetched portion on the mask surface.

The over-etching causes the X-ray transparent film, which is the bottom layer of the X-ray absorber film, to be exposed to plasma. If the bottom layer of the X-ray absorber film is, for example, an X-ray transparent film composed of a silicon carbide, then the etching speed for the X-ray transparent film exceeds a negligible speed in relation to the etching conditions of the X-ray absorber film. Hence, the X-ray transparent film is over-etched, leading to a thinner bottom layer, namely, the X-ray transparent film, and a deteriorated pattern configuration of the X-ray absorber film itself. The thinner X-ray transparent film undesirably causes a change in the optical transmittance required for the alignment when mounting the film on an X-ray aligner, or adds to the positional distortion of the mask.

Therefore, it is preferable to insert an etching stopper layer between the X-ray absorber film and the X-ray transparent film, the etching stopper layer being made of a material which is hard to be etched (which has a high etching selective ratio) when etching the X-ray absorber film.

Hitherto, chlorine gas has been used for etching an X-ray absorber film containing Ta as a chief ingredient thereof, while a Cr film has been used as the etching mask layer and the etching stopper layer that enable a high etching selective ratio for the X-ray absorber film. A fluoride gas such as $SF_6$ has been used for etching the X-ray absorber film which has W as the chief ingredient thereof, and the Cr films have been used for the etching mask layer and the etching stopper layer for the X-ray absorber film. These Cr films are formed on the bottom and/or the top of the X-ray absorber film by the sputtering method in most cases.

High positional accuracy is required of the X-ray mask; for instance, the distortion of the X-ray mask for a 1-Gbit DRAM which has a 0.18 $\mu$m design rule pattern must be controlled to 22 nm or less.

The positional distortion is heavily dependent on the stress of the material of the X-ray mask; if the stress of the X-ray absorber film, the etching mask layer, or the etching stopper layer is high, then the positional distortion is provided. Hence, the stress of the X-ray absorber film, the etching mask layer, and the etching stopper layer must be minimized.

No satisfactory study, however, has been performed on the stress of the X-ray masks for the DRAMs of 1 Gbits or more.

SUMMARY OF THE INVENTION

Accordingly, it is an object of the present invention to provide mainly an X-ray mask blank suited for manufacturing an X-ray mask having an extremely low stress and hence exhibiting an extremely high positional accuracy.

To this end, the inventors have devoted themselves to the study on the stress of the X-ray masks and have found out that a Cr film, which has been predominantly employed in the past, is advantageous in that it has an etching selective ratio (the X-ray absorber film relative to the Cr film) which is ten times or more in relation to the X-ray absorber film. It has been found, however, that the Cr film, which is a crystalline film, is scarcely dependent upon the film preparing condition in the sputtering process, and exhibits a high tensile stress of 800 MPa or more when, for example, the thickness of the etching mask layer or the etching stopper layer is set to approximately 0.05 $\mu$m. The inventors have also found that applying the Cr film having such a high stress to the etching mask layer or the etching stopper layer leads to a poor positional accuracy due to the positional distortion caused by the stress, making it difficult to manufacture the X-ray masks for the DRAMs of 1 Gbits or more.

Further study including simulation analyses carried out by the inventors has disclosed that the stress of the X-ray absorber film having a thickness of, for instance, 0.5 $\mu$m must be controlled to ±10 MPa or less, and the stress of the etching mask layer and/or the etching stopper layer having a thickness of, for example, 0.05 $\mu$m must be controlled to ±200 MPa or less.

The positional distortion of the mask is also influenced by the thickness of the etching mask layer and the etching stopper layer. More specifically, the force of the films responsible for the positional distortion depends on the product of the film stress and the film thickness, so that the required stress changes depending on the film thickness. Thus, it has been discovered that the product of the film stress and the film thickness need to be controlled to the range of 0 to $\pm 1\times 10^4$ dyn/cm in order to achieve a higher positional accuracy.

Further, for the X-ray masks for the DRAMs of 1 Gbits or more, it is required that the internal stress of the etching mask layer and the etching stopper layer be uniform in a pattern area of 25 mm square or larger in order to accomplish the required positional accuracy. This is because unevenly distributed stress would lead to a distorted pattern. The inventors have discovered that the product of the film stress and thickness of the etching mask layer and the etching stopper layer at a plurality of arbitrary points in an area corresponding to the pattern area of the X-ray mask must be controlled to the range of 0 to $\pm 1\times 10^4$ dyn/cm so as to attain a higher positional accuracy. Based on the findings, the inventors have completed the present invention.

The progress in the technology for measuring equipment in recent years has improved stress measurement accuracy. For instance, the stress measuring equipment developed by NTT Advance Technology K.K. is designed to be able to measure the distribution of stress with high accuracy in a conventional method wherein the radius of curvature of a substrate is measured to measure the stress. The inventors have found that the distribution of stress can also be measured by a bulge method wherein a self-sustained membrane is subjected to a differential pressure and the resulting deformation of the membrane is measured (T. Shoki et al, SPIE 1924,450(1993)). These two methods enable accurate measurement of the distribution of stress in the substrate.

Based on the findings described above, according to one aspect of the present invention, there is provided an X-ray mask blank which has an X-ray transparent film on a substrate, and an X-ray absorber film on the X-ray transparent film, wherein the top and/or the bottom of the X-ray absorber film is provided with a film in which the product of the film stress and the film thickness ranges from 0 to $\pm 1\times 10^4$ dyn/cm.

In the X-ray mask blank which has an X-ray transparent film on a substrate, and an X-ray absorber film on the X-ray transparent film, the top and/or the bottom of the X-ray absorber film is provided with a film in which the product of the film stress and the film thickness at a plurality of points in a predetermined area ranges from 0 to $\pm 1\times 10^4$ dyn/cm.

The X-ray mask blank according to the invention is configured such that:

- the film on the top of the X-ray absorber film is an etching mask layer employed as the mask layer for patterning of the X-ray absorber film;
- the film on the bottom of the X-ray absorber film is an etching stopper layer which has a high selective ratio for the etching of the X-ray absorber film;
- the product of the film stress and the thickness of the X-ray absorber film ranges from 0 to $\pm 5\times 10^3$ dyn/cm;
- the product of the film stress and the thickness at a plurality of points in a predetermined area of the X-ray absorber film ranges from 0 to $\pm 5\times 10^3$ dyn/cm; or
- the X-ray absorber film is composed of a material containing a metal of a high melting point as the chief ingredient thereof, and the films on the top and/or bottom of the X-ray absorber film is composed of a material containing Cr as the chief ingredient thereof.

The X-ray mask in accordance with the present invention is manufactured by patterning the X-ray absorber film of the aforesaid X-ray mask blank according to the present invention.

Further, the pattern transfer method in accordance with the present invention is adapted to transfer a pattern onto a target substrate by employing the X-ray mask in accordance with the present invention.

According to the present invention, the product of the film stress and thickness of the etching mask layer and the etching stopper layer is controlled to the range of 0 to $\pm 1\times 10^4$ dyn/cm, making it possible to accomplish an X-ray mask having a minimum of positional distortion caused by stress, thus permitting an extremely high positional accuracy.

The pattern distortion attributable to unevenly distributed stress can be prevented so as to achieve yet higher positional accuracy by controlling the product of the film stress and the film thickness at a plurality of points in a predetermined area to the range of 0 to $\pm 1\times 10^4$ dyn/cm.

Further, extremely low stress can be achieved while maintaining a high etching selective ratio by using a material having, for example, chromium as the chief ingredient thereof rather than using chromium only for the etching mask layer and the etching stopper layer.

Furthermore, an X-ray mask having an extremely high pattern accuracy and an extremely high positional accuracy can be obtained by optimizing the film thicknesses or film compositions of the etching mask layer and the etching stopper layer within a relatively limited range.

The present invention ensures high productivity in the mass production of the X-ray masks for the DRAMs of 1

Gbits or more; it is also suited for the X-ray masks for the DRAMs of 4 Gbits or more (design rules of 0.13-$\mu$m line and space or less).

The present invention will now be explained in more detail.

First, the X-ray mask blank in accordance with the present invention will be explained.

The X-ray mask blank in accordance with the present invention has an X-ray transparent film on a substrate, and an X-ray absorber film on the X-ray transparent film.

As the substrate, a silicon substrate, i.e. a silicon wafer, is frequently used; however, it is not limited thereto. A well-known substrate such as a quartz glass substrate may be employed instead.

As the X-ray transparent film, a SiC, SiN, or diamond thin film may be used. From the standpoint primarily of the resistance to the exposure to X-rays, the SiC thin film is preferable.

Preferably, the film stress of the X-ray transparent film ranges from 50 to 400 MPa.

Preferably, the thickness of the X-ray transparent film ranges from about 1 $\mu$m to about 3 $\mu$m.

Preferably, the film stress of the X-ray absorber film is 10 MPa or less.

Preferably, the thickness of the X-ray absorber film ranges from about 0.3 $\mu$m to about 0.8 $\mu$m.

Preferably, the product of the film stress and the thickness of the X-ray absorber film ranges from 0 to $\pm 1\times 10^4$ dyn/cm; and further preferably, it stays within the range of 0 to $\pm 5\times 10^3$ dyn/cm. This will prevent a pattern from being distorted by unevenly distributed stress, thus contributing to a higher positional accuracy.

There are no particular restrictions on the material used for the X-ray absorber film; however, it is preferable to use a material which contains Ta, W, or other metal having a high melting point as the chief ingredient thereof.

As the X-ray absorber film, a compound of Ta and B such as $Ta_4B$ (Ta:B=8:2) or a tantalum boride having a composition other than $Ta_4B$, metal Ta, an amorphous material containing Ta, a Ta-based material containing Ta and other ingredient, metal W, a W-based material containing W and other ingredient. For the X-ray absorber film composed of such a material, a material containing Cr as the chief ingredient is effectively used for the etching mask layer or the etching stopper layer.

The X-ray absorber material containing tantalum as the chief ingredient thereof preferably has an amorphous structure or a microcrystal structure. This is because a crystal structure or a metal structure would make it difficult to perform submicron-order microprocessing, and would generate a high internal stress, causing the X-ray mask to be distorted.

The X-ray absorber material containing tantalum as the chief ingredient thereof preferably contains at least B in addition to Ta. This is because an X-ray absorber film containing Ta and B provides such advantages as a lower internal stress, a high purity, and a high rate of X-ray absorption; and moreover, it permits easier control of the internal stress by controlling the gas pressure when forming the film by sputtering.

The proportion of B in the X-ray absorber film which contains Ta and B is preferably 15 to 25 atomic percent. If the proportion of B in the X-ray absorber film exceeds the foregoing range, then the particle diameter of the microcrystal is too large, making the submicron-order microprocessing difficult. The inventors have already filed the application on the proportion of B in the X-ray absorber film under Japanese Unexamined Patent Publication No. Hei 2-192116.

The X-ray mask blank according to the present invention is characterized in that the top and bottom of the X-ray absorber film are provided with films, the product of the stress and thickness of the film ranging from 0 to $\pm 1\times 10^4$ dyn/cm.

If the product of the stress and thickness of the film exceeds the aforesaid range, then marked positional distortion attributable to stress will result, making it impossible to produce an X-ray mask having an extremely high positional accuracy.

It is especially preferable to control the product of the film stress and thickness of the etching mask layer and/or the etching stopper layer at a plurality of arbitrary points in an area which corresponds to a pattern area of the X-ray mask to the range of 0 to $\pm 1\times 10^4$ dyn/cm. By so doing, the distortion of the pattern caused by unevenly distributed stress will be prevented, thus enabling a higher positional accuracy to be attained.

For the same reason, it is preferable to set the product of the film stress and the film thickness to the range of 0 to $\pm 8\times 10^3$ dyn/cm; and it is further preferable to set the product to the range of 0 to $\pm 5\times 10^3$ dyn/cm.

As the film on the top of the X-ray absorber film, there is an etching mask layer employed as, for example, the mask layer for patterning the X-ray absorber film. In this case, the film thickness should be about 200 to about 2000 angstroms. In the present invention, however, the film on the top of the X-ray absorber film is not limited to the etching mask layer; it may be a protective layer, a conductive layer, or other film formed for various other purposes because they all serve the purpose of the stress control described above.

As the film on the bottom of the X-ray absorber film, there is an etching stopper layer which has a high selective ratio for the etching of the X-ray absorber film. In this case, the film thickness should be about 100 to about 1200 angstroms. In the present invention, however, the film on the bottom of the X-ray absorber film is not limited to the etching stopper layer; it may be an adhesion layer, a reflection preventive layer, a conductive layer, or other film formed for various other purposes because they all serve the purpose of the stress control described above.

A material containing Cr as the chief ingredient thereof, $SiO_2$, $Al_2O_3$, or the like may be used for the etching mask layer when the X-ray absorber film is Ta-based; a material containing Cr as the chief ingredient thereof, indium-tin oxide (ITO), Ti, etc. may be used when the X-ray absorber film is W-based.

A material containing Cr as the chief ingredient thereof, $Al_2O_3$, or the like may be used for the etching stopper layer when the X-ray absorber film is Ta-based; a material containing Cr as the chief ingredient thereof, ITO, etc. may be used when the X-ray absorber film is W-based.

Materials such as $SiO_2$, $Al_2O_3$, and ITO enable the film stress to be controlled by controlling the pressure of sputtering gas or other film forming conditions. In the case of metal crystalline materials such as Cr and Ti, the film stress can be controlled by adding carbon, nitrogen, oxygen, etc.

In the present invention, there are no particular restrictions on the material used for the films on the top and/or the bottom of the X-ray absorber film.

A material primarily made up of, for example, Cr (e.g. a material containing chromium and carbon) may be employed for the film on the top and/or the bottom of the X-ray absorber film. As compared with the material composed of Cr alone, the material containing Cr as the chief ingredient permits an extremely low stress to be achieved while maintaining a high etching selective ratio; and delicate control of the film stress can be conducted by finely adjusting the composition, i.e. the mixing ratio of a sputtering gas.

The stress also depends on the total sputtering gas pressure, RF power, and the type of a sputtering apparatus, meaning that it can also be adjusted by them.

As the material having Cr as the chief ingredient thereof, there are materials containing carbon, nitrogen, oxygen, etc. in addition to chromium (binary-based or more). In the case of the material containing Cr as the chief ingredient, it is possible to improve primarily the resistance to heat and cleaning by adding nitrogen, oxygen, carbon, etc. (ternary-based or more) to an extent that does not affect the etching selective ratio or the film stress.

A film composed of a material containing chromium as the chief ingredient can be formed by the sputtering process in which metal chromium serves as the sputtering target, and a gas containing carbon, nitrogen, or oxygen is mixed in the sputtering gas.

The sputtering process may include, for instance, RF magnetron sputtering, DC sputtering, and DC magnetron sputtering.

As the gas containing carbon, there are, for example, hydrocarbon-based gases including methane, ethane, and propane.

As the sputtering gas, there are, for example, inert gases including argon, xenon, krypton, and helium.

The thickness of the etching mask layer composed of a material having chromium as the chief ingredient thereof is 10 to 100 nm, preferably 10 to 60 nm, and more preferably 10 to 50 nm.

A thinner etching mask layer enables an etching mask pattern of a vertical side wall to be obtained, and also reduces the influences on micro-loading effect. This makes it possible to reduce the pattern conversion difference produced when dry-etching the X-ray absorber material layer by using the etching mask pattern as the mask.

The thickness of the etching stopper layer composed of a material primarily made up of chromium is 5 to 100 nm, preferably 7 to 50 nm, and more preferably 10 to 30 nm.

A thinner etching stopper layer permits a shorter etching time, thus reducing the deformation of the X-ray absorber caused by etching when removing the etching stopper layer.

The X-ray mask blank in accordance with the present invention can be manufactured by applying a conventional, well-known manufacturing process for X-ray mask blanks.

The X-ray mask in accordance with the present invention is characterized in that it can be manufactured using the X-ray mask blank in accordance with the present invention explained above. There are no particular restrictions on other processes; a conventional, well-known manufacturing process for X-ray masks can be applied.

For instance, the patterning of the etching mask layer is performed using a well-known patterning technique employing resist (photo resist, electron beam) such as lithography mainly including the steps of applying resist, exposure, development, etching, removing the resist, and cleaning, a multilayer resist process, and a multilayer mask (metal film/resist film, etc.) process. A thinner resist film provides a better result; it is 50 to 1000 nm thick, and preferably 100 to 300 nm.

It is preferable to use a mixed gas of chlorine and oxygen as the etching gas for dry-etching the etching mask layer, the etching stopper layer, etc. which is composed of a material having chromium as the chief ingredient thereof.

The use of the mixed gas in which oxygen has been added to chlorine serving as the etching gas makes it possible to greatly slow down the etching speed, i.e. the etching rate, for the material containing Ta as the chief ingredient thereof. This in turn makes it possible to increase the etching selective ratio of the material primarily composed of Cr to the material primarily composed of Ta, enabling the relative etching speed to be reversed as compared with a case wherein the etching gas is composed of chlorine alone (the etching selective ratio is 0.1).

Apparatuses that may be used for dry etching or plasma etching include a reactive ion beam etching (RIBE) apparatus such as an electron cyclotron resonance (ECR) etching apparatus, a reactive ion etching (RIE) apparatus, an ion beam etching (IBE) apparatus, and an optical etching apparatus.

The pattern transfer method in accordance with the present invention is characterized in that a pattern is transferred to a target substrate by using the X-ray mask in accordance with the present invention explained above; there are no particular restrictions on the rest, and a conventional well-known pattern transfer technique may be applied.

DESCRIPTION OF THE PREFERRED EMBODIMENTS

The present invention will now be explained in more detail in conjunction with embodiments.

First Embodiment

Figure 3A:
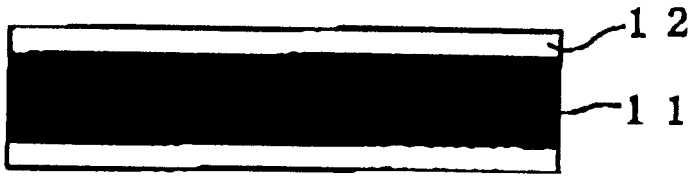
FIG. 3A through FIG. 3C illustrate the manufacturing process of an X-ray mask blank according to an embodiment of the present invention.
Figure 3B:
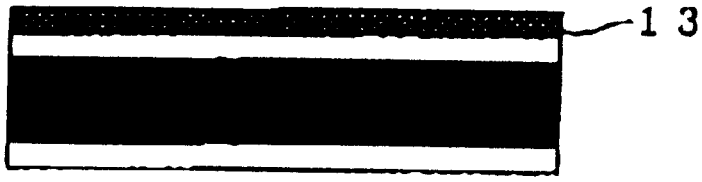
Figure 3C:
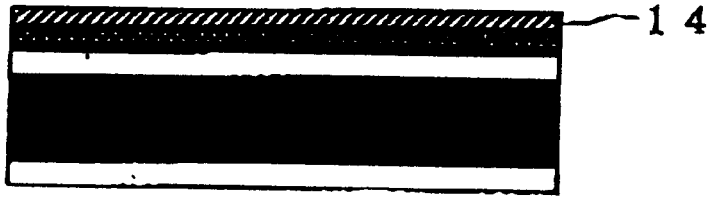

FIG. 3A through FIG. 3C are cross-sectional views illustrating the manufacturing process of an X-ray mask blank according to an embodiment of the present invention.

As shown in FIG. 3A, silicon carbide films are formed as X-ray transparent films 12 to produce X-ray mask membranes on both surfaces of a silicon substrate 11.

As the silicon substrate 11, a single crystal silicon substrate measuring 3 inches in diameter and 2 mm in thickness and having a crystal orientation of (100) was used. The silicon carbide films serving as the X-ray transparent films 12 were formed to a thickness of 2 $\mu$m by CVD using dichlorosilane and acetylene. The film surfaces were smoothed by mechanical polishing until the surface roughness reached Ra=1 nm or less.

Then, as shown in FIG. 3B, an X-ray absorber film 13 composed of tantalum and boron was formed on the X-ray transparent film 12.

For the X-ray absorber film 13, a compound which contains tantalum and boron at an atomicity ratio (Ta/B) of 8/2 was used as the sputtering target. The Ta—B film of a 0.5 $\mu$m thickness was produced by the RF magnetron sputtering method using argon as the sputtering gas. The sputtering conditions were set such that the RF power density was 6.5 $W/cm^2$ and the sputtering gas pressure was 1.0 Pa.

The Ta—B film obtained as described above was annealed at 300 degrees Celsius to produce a uniform low-stress film which has a stress of ±10 MPa or less in a 25 mm-square area.

In the next step, as shown in FIG. 3C, a chromium film containing carbon was formed as an etching mask layer 14 on the X-ray absorber film 13 to a thickness of 0.05 $\mu$m in the 25 mm-square area by the RF magnetron sputtering method.

As the sputtering target, Cr was employed, and a gas composed of Ar to which 7% of methane had been added was used as the sputtering gas. The sputtering conditions were set such that the RF power density was 6.5 $W/cm^2$, the sputtering gas pressure was 1.2 Pa. Thus, an etching mask layer having a low stress of ±200 MPa or less was obtained.

The product of the film stress and thickness in the 25 mm-square area of the film constituting the etching mask layer obtained as described above was $+4.0\times10^3$ dyn/cm or less.

A high-accuracy stress measuring apparatus of NTT Advance Technology was used to measure then stress distribution along the radius of curvature of the silicon substrate before and after forming the film at arbitrary 256 points in the substrate surface. The thickness distribution was measured using a step meter or a tally-step.

An X-ray mask was produced by using the X-ray mask blank obtained as mentioned above, and the positional distortion thereof was measured using a coordinate measuring instrument. Table 1 below shows the measurement results which indicate that the positional distortion of the x-ray mask is 22 nm or less which meets the requirement for the X-ray mask for 1-Gbit DRAMs. Thus, it has been verified that the X-ray mask is capable of implementing high positional accuracy.

TABLE 1

| | Ar:CH4 | Film Thickness ($\mu$m) | Max. Film Stress × ($10^7$ dyn/cm) | Film Stress After Annealing × ($10^7$ dyn/cm) | Stress × Film Thickness (dyn/cm) | Positional Accuracy 3 σ (nm) |
|---|---|---|---|---|---|---|
| 1st Comparative Example | 100:0 | 0.05 | +800 | — | $+4.0\times10^3$ or less | 50 |
| 2nd Comparative Example | 95:5 | 0.05 | +300 | — | $+1.5\times10^3$ or less | 28 |
| 1st Embodiment | 93:7 | 0.05 | +80 | — | $+4.0\times10^3$ or less | 17 |
| 2nd Embodiment | 92:8 | 0.05 | +20 | — | $+1.0\times10^3$ or less | 12 |
| 3rd Embodiment | 91:9 | 0.05 | −150 | — | $-7.5\times10^3$ or less | 20 |
| 4th Embodiment | 90:10 | 0.05 | −400 | −80 | $-4.0\times10^3$ or less | 18 |

Second and Third Embodiments

As second and third embodiments, the X-ray mask blanks and the X-ray masks were produced in the same manner as the first embodiment except that the 8% of methane was added to Ar as the sputtering gas in the second embodiment and 9% of methane gas was added in the third embodiment, and the product of the film stress and thickness in the 25 mm-square area of the film constituting the etching mask layer was set to $+1.0\times10^3$ dyn/cm or less for the second embodiment and to $-7.5\times10^3$ dyn/cm or less for the third embodiment. The same evaluation on the second and third embodiments were carried out.

As shown in Table 1 above, it has been verified that the second and third embodiments also meet the required positional accuracy.

First and Second Comparative Examples

As first and second comparative examples, the X-ray mask blanks and the X-ray masks were produced in the same manner as the first embodiment except that the sputtering gases shown in Table 1 were used, and the product of the film stress and thickness in the 25 mm-square area of the film constituting the etching mask layer was set to exceed $\pm1\times10^4$ dyn/cm. The same evaluation on the first and second comparative examples was carried out.

The evaluation results given in Table 1 indicate that the first and second comparative examples fail to meet the required positional accuracy.

Fourth Embodiment

The manufacturing process for the X-ray mask blank according to a fourth embodiment is the same as that for the first embodiment; therefore, the fourth embodiment will be explained with reference to FIG. 3.

As shown in FIG. 3A, silicon carbide films are formed as X-ray transparent films 12 to produce X-ray mask membranes on both surfaces of a silicon substrate 11.

As the silicon substrate 11, a silicon substrate measuring 3 inches in diameter and 2 mm in thickness and having a crystal orientation of (100) was used. The silicon carbide films serving as the X-ray transparent films 12 were formed to a thickness of 2 $\mu$m by CVD using dichlorosilane and acetylene. The film surfaces were smoothed by mechanical polishing until the surface roughness reached Ra=1 nm or less.

Then, as shown in FIG. 3B, an X-ray absorber film 13 composed of tantalum and boron was formed on the X-ray transparent film 12.

For the X-ray absorber film 13, a compound which contains tantalum and boron at an atomicity ratio (Ta/B) of 8/2 was used as the sputtering target. The Ta—B film of a 0.5 $\mu$m thickness was produced by the RF magnetron sputtering method using argon as the sputtering gas. The sputtering conditions were set such that the RF power density was 6.5 $W/cm^2$ and the sputtering gas pressure was 1.0 Pa.

The Ta—B film obtained as described above was annealed at 300 degrees Celsius to produce a uniform low-stress film which has a stress of 10 MPa or less in a 25 mm-square area.

In the next step, as shown in FIG. 3C, a film containing chromium carbide was formed as an etching mask layer 14 on the X-ray absorber film 13 to a thickness of 0.05 $\mu$m in the 25 mm-square area by the RF magnetron sputtering method.

As the sputtering target, Cr was employed, and a gas composed of Ar to which 10% of methane had been added was used as the sputtering gas. The sputtering conditions were set such that the RF power density was 6.5 $W/cm^2$, the sputtering gas pressure was 1.2 Pa. Thus, an etching mask layer having a stress of maximum −400 MPa in the 25 mm-square area was obtained. This film is characteristic in that annealing it at a high temperature causes the stress thereof to change in the tensile direction; hence, by taking advantage of this characteristic, the film was annealed at 250 degrees Celsius to obtain a low-stress film having a stress of −80 MPa in the 25 mm-square area.

The product of the film stress and thickness in the 25 mm-square area of the film constituting the etching mask layer obtained as described above was $-4.0\times10^3$ dyn/cm or less.

A high-accuracy stress measuring apparatus of NTT Advance Technology was used to measure then stress distribution along the radius of curvature of the silicon substrate before and after forming the film at arbitrary 256 points in the substrate surface. The thickness distribution of the film was measured using a step meter or a tally-step.

An X-ray mask was produced by using the X-ray mask blank obtained as mentioned above, and the positional distortion thereof was measured using a coordinate measuring instrument. As indicated in Table 1, it has been verified that the positional distortion of the x-ray mask is 22 nm or less which meets the requirement for the X-ray mask for 1-Gbit DRAMs. Thus, it has been verified that the X-ray mask is capable of implementing high positional accuracy.

Figure 4:
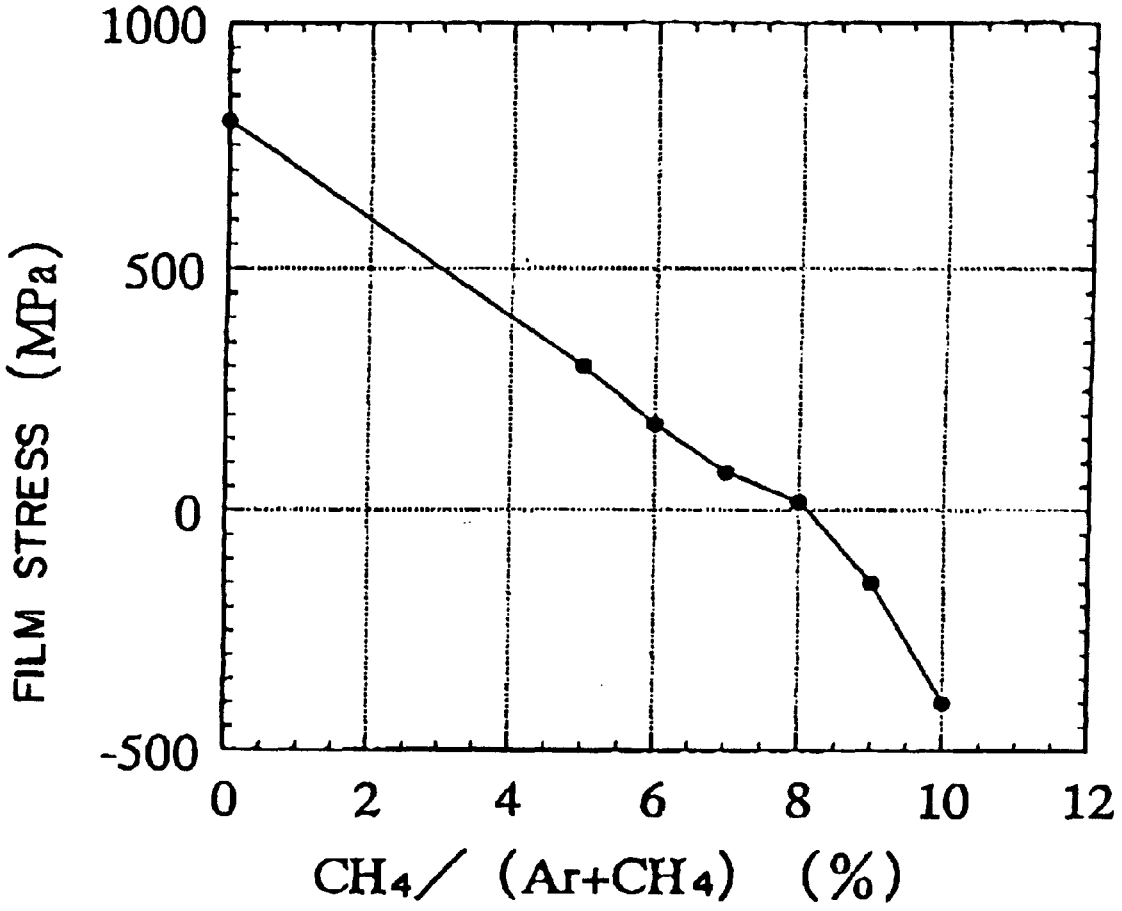
FIG. 4 is a chart showing the relationship between the mixing ratio of a sputtering gas and film stress.

FIG. 4 shows the relationship between the mixing ratios of the sputtering gases and the film stress of the films constituting the etching mask layers in the first through third embodiments and the first and second comparative examples.

From FIG. 4, it is understood that delicate control of the film stress can be accomplished by finely adjusting the mixing ratio of the sputtering gas.

Fifth Embodiment

Figure 5A:
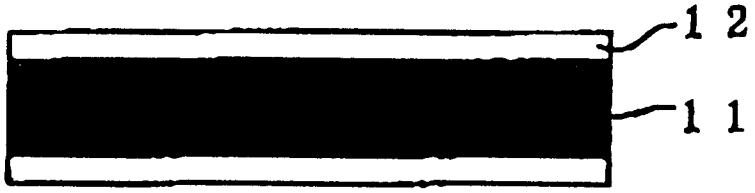
FIG. 5A through FIG. 5C illustrate the manufacturing process of an X-ray mask blank according to another embodiment of the present invention.
Figure 5B:
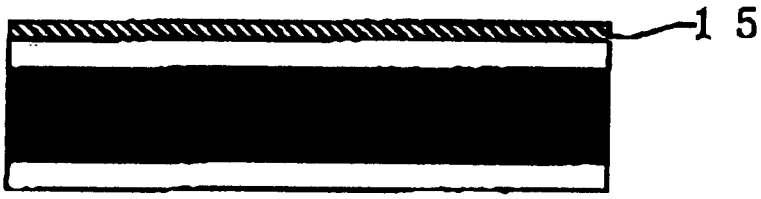
Figure 5C:
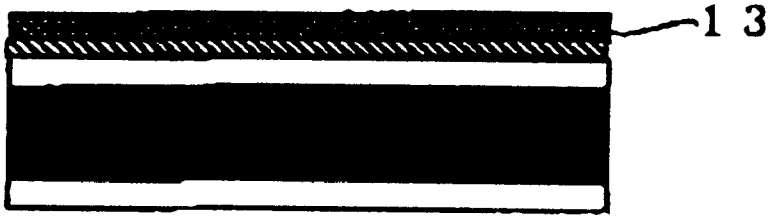

FIG. 5A through FIG. 5C are cross-sectional views illustrating the manufacturing process for the X-ray mask blank according to a fifth embodiment.

First, silicon carbide films are formed as X-ray transparent films (X-ray mask membranes) 12 on both surfaces of a silicon substrate 11 as shown in FIG. 5A.

As the silicon substrate 11, a silicon substrate measuring 3 inches in diameter and 2 mm in thickness and having a crystal orientation of (100) was used. The silicon carbide films serving as the X-ray transparent films 12 were formed to a thickness of 2 $\mu$m by CVD using dichlorosilane and acetylene. The film surfaces were smoothed by mechanical polishing until the surface roughness reached Ra=1 nm or less.

In the next step, a film containing chromium and carbon was formed as an etching stopper layer 15 on the X-ray transparent film 12 to a thickness of 0.02 $\mu$m by the RF magnetron sputtering method as illustrated in FIG. 5B. As a result, the low-stress etching stopper layer 15 having a stress of ±500 MPa or less was obtained.

As the sputtering target, Cr was used, and the sputtering gas composed of Ar to which 8% of methane had been mixed in was used. The sputtering conditions were set such that the RF power density was 6.5 $W/cm^2$ and the sputtering gas pressure was 1.2 Pa.

Then, as shown in FIG. 5C, an X-ray absorber film 13 composed of tantalum and boron was formed on the etching stopper layer 15 to a thickness of 0.5 $\mu$m by the RF magnetron sputtering process.

The sputtering target was a sintered compact which contains tantalum and boron at an atomicity ratio (Ta/B) of 8/2. The sputtering gas was an Ar gas, and the sputtering conditions were set such that the RF power density was 6.5 $W/cm^2$ and the sputtering gas pressure was 1.0 Pa.

Subsequently, the substrate was annealed at 250 degrees Celsius for two hours under a nitrogen atmosphere to produce a low-stress X-ray absorber film 13 which has a stress of 10 MPa or less.

An X-ray mask was produced by using the X-ray mask blank obtained as mentioned above, and the positional distortion thereof was measured using a coordinate measuring instrument. The measurement results have indicated that the positional distortion of the x-ray mask is 22 nm or less which meets the requirement for the X-ray mask for 1-Gbit DRAMs. Thus, it has been verified that the X-ray mask is capable of implementing high positional accuracy.

Sixth Embodiment

FIG. 6A through FIG. 6D show the manufacturing process for the X-ray mask blank according to a sixth embodiment.

Figure 6A:
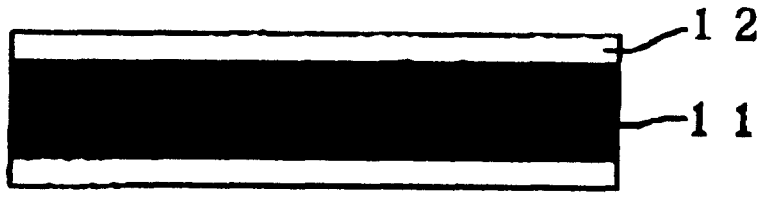
FIG. 6A through FIG. 6D illustrate the manufacturing process of the X-ray mask blank according to yet another embodiment of the present invention.

First, silicon carbide films are formed as X-ray transparent films (X-ray mask membranes) 12 on both surfaces of a silicon substrate 11 as shown in FIG. 6A.

As the silicon substrate 11, a silicon substrate measuring 3 inches in diameter and 2 mm in thickness and having a crystal orientation of (100) was used. The silicon carbide films serving as the X-ray transparent films 12 were formed to a thickness of 2 $\mu$m by CVD using dichlorosilane and acetylene. The film surfaces were smoothed by mechanical polishing until the surface roughness reached Ra=1 nm or less.

Figure 6B:
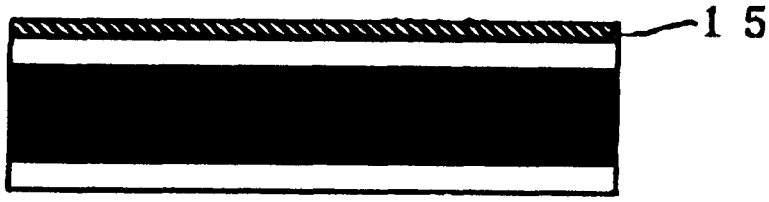

In the next step, a film containing chromium and carbon was formed as an etching stopper layer 15 on the X-ray transparent film 12 to a thickness of 0.02 $\mu$m by the RF magnetron sputtering method as illustrated in FIG. 6B. As a result, the low-stress etching stopper layer 15 having a stress of 500 MPa or less was obtained.

As the sputtering target, Cr was used, and the sputtering gas composed of Ar to which 8% of methane had been mixed in was used. The sputtering conditions were set such that the RF power density was 6.5 $W/cm^2$ and the sputtering gas pressure was 1.2 Pa.

Figure 6C:
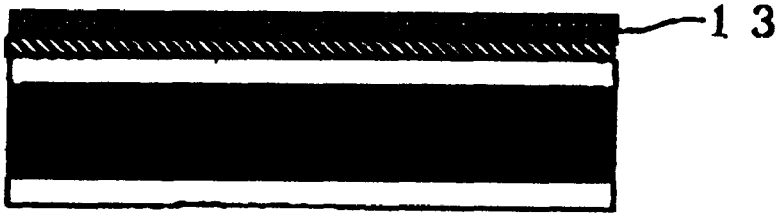

Then, as shown in FIG. 6C, an X-ray absorber film 13 composed of tantalum and boron was formed on the etching stopper layer 15 to a thickness of 0.5 $\mu$m by the RF magnetron sputtering process.

The sputtering target was a sintered compact which contains tantalum and boron at an atomicity ratio (Ta/B) of 8/2. The sputtering gas was an Ar gas, and the sputtering conditions were set such that the RF power density was 6.5 $W/cm^2$ and the sputtering gas pressure was 1.0 Pa.

Subsequently, the substrate was annealed at 250 degrees Celsius for two hours under a nitrogen atmosphere to produce a low-stress X-ray absorber film 13 which has a stress of 10 MPa or less.

Figure 6D:
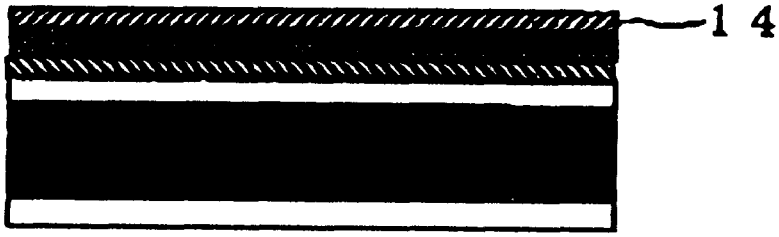

In the next step, a film containing chromium and carbon was formed as an etching mask layer 14 on the X-ray absorber film 13 to a thickness of 0.05 $\mu$m by the RF magnetron sputtering process as shown in FIG. 6D. As a result, the low-stress etching mask layer 14 having a stress of 200 MPa or less was obtained.

As the sputtering target, Cr was employed, and an Ar gas to which 10% of methane had been added was employed. The sputtering conditions were set such that the RF power density was 6.5 W/cm$^2$ and the sputtering gas pressure was 0.6 Pa.

An X-ray mask was produced by using the X-ray mask blank obtained as mentioned above, and the positional distortion thereof was measured using a coordinate measuring instrument. The measurement results have indicated that the positional distortion of the x-ray mask is 22 nm or less which meets the requirement for the X-ray mask for 1-Gbit DRAMs. Thus, it has been verified that the X-ray mask is capable of implementing high positional accuracy.

The section of the pattern of the X-ray mask obtained in the sixth embodiment was observed through a scanning electron microscope (SEM). It has been verified that the 0.18 $\mu$m line & space X-ray absorber pattern has an extremely good quality represented, for example, by the good verticality of the side wall, the good surface condition of the side wall, and the good linearity of lines.

Further, it was also checked whether the X-ray transparent film had become thinner after removing the etching stopper layer. No reduction in thickness has been observed in the X-ray transparent film.

The present invention has been explained by referring to the preferred embodiments; however, the present invention is not limited to the embodiments which have been explained above.

For instance, in the foregoing embodiments, the films were formed using the RF magnetron sputtering process; however, the present invention is not limited thereto; the same advantages can be obtained by using a commonly employed sputtering process such as DC magnetron sputtering process to form the etching mask layer, the etching stopper layer, etc.

Likewise, in the foregoing embodiments, the mixed gas composed of argon and methane as the sputtering gas; however, the present invention is not limited thereof; an inert gas such as xenon, krypton, and helium may be used in place of argon, and a hydrocarbon-based gas such as ethane and propane may be used in place of methane to obtain the same advantages.

Furthermore, the material for the etching mask layer and the etching stopper layer may contain nitrogen or oxygen in addition to chromium and carbon.

For the X-ray absorber film, other material such as metal Ta, an amorphous material containing Ta, or tantalum boride having a composition other than $Ta_4B$ may be used in place of the compound of Ta and B (Ta:B=8:2).

Figure 1:
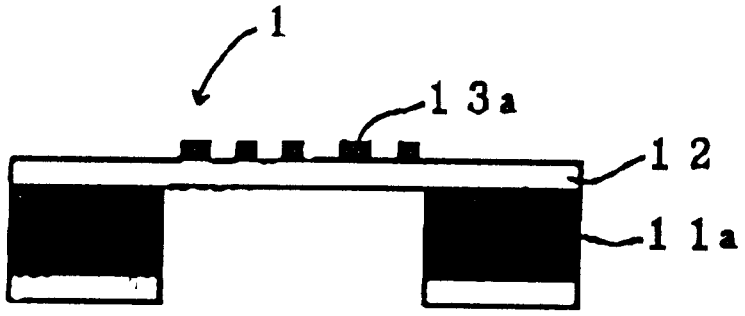
FIG. 1 PRIOR ART
FIG. 1 is cross-sectional view illustrating the structure of an X-ray mask.
Figure 2:
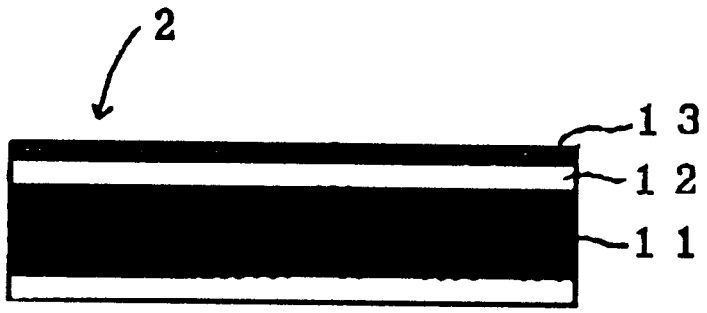
FIG. 2 PRIOR ART
FIG. 2 is a diagram illustrating an X-ray mask blank.

The structure of the X-ray mask blank is not limited to the one shown in FIG. 2. In an alternative structure, the silicon at the central part on the back surface may be removed by etching after forming the X-ray transparent film to produce a membrane structure.

Thus, according to the present invention, the product of the film stress and the film thickness of the etching mask layer and the etching stopper layer is limited to the range of 0 to $\pm 1\times 10^4$ dyn/cm; hence, the positional distortion attributable to stress can be minimized, permitting an X-ray mask having an extremely high positional accuracy to be produced.

In particular, the product of the film stress and the film thickness of the etching mask layer and the etching stopper layer at a plurality of arbitrary points in an area corresponding to the pattern area of the X-ray mask is limited to the range of 0 to $\pm 1\times 10^4$ dyn/cm. This prevents the distortion of the pattern caused by unevenly distributed stress, thus enabling a higher positional accuracy.

What is claimed is:

1. An X-ray mask blank comprising:

(a) a substrate;

(b) an X-ray transparent film formed on said substrate;

(c) an X-ray absorber film formed on said X-ray transparent film; and (d) an etching mask film formed on said X-ray absorber film for patterning said X-ray absorber film;

the product of the film stress and film thickness of said etching mask film being in the range of 0 to $\pm 1\times 10^4$ dyn/cm.

2. An X-ray mask blank according to claim 1, wherein the product of film stress an film thickness of said etching mask film is the range of 0 to $\pm 1\times 10^4$ dyn/cm, at a plurality of points in a predetermined area.

3. An X-ray mask blank according to claim 1, wherein the product of film stress and film thickness of said X-ray absorber film is in the range of 0 to $\pm 5\times 10^3$ dyn/cm.

4. An X-ray mask blank according to claim 3, wherein the product of film stress and film thickness of said X-ray absorber film is in the range of 0 to $\pm 5\times 10^3$ dyn/cm, at a plurality of points in a predetermined area.

5. An X-ray mask blank according to claim 1, wherein said X-ray absorber film is composed of material primarily made up of metal with a high melting point, and said etching mask film is composed of a material primarily made up of Cr.

6. An X-ray mask blank comprising:

(a) a substrate;

(b) an X-ray transparent film formed on said substrate;

(c) an etching stopper film having a high selective etching ratio for an X-ray absorber film formed thereon; and (d) the X-ray absorber film formed on said etching stopper film; the product of film stress and film thickness of said etching stopper film being in the range of 0 to $\pm 1\times 10^4$ dyn/cm.

7. An X-ray mask blank according to claim 6, wherein the product of film stress and film thickness of said etching stopper film is in the range of 0 to $\pm 1\times 10^4$ dyn/cm at a plurality of points in a predetermined area.

8. An X-ray mask blank according to claim 7, wherein the product of film stress and film thickness of said X-ray absorber film is in the range of 0 to $\pm 5\times 10^3$ dyn/cm.

9. An X-ray mask blank according to claim 8, wherein the product of film stress and film thickness of said X-ray absorber film is in the range of 0 to $\pm 5\times 10^3$ dyn/cm, at a plurality of points in a predetermined area.

10. An X-ray mask blank according to claim 6, wherein said X-ray absorber film is composed of a material primarily made up of a metal with a high melting point, and said etching mask film is composed of a material primarily made up of Cr.

11. A method for manufacturing an X-ray mask, said method comprising the steps of:

(a) preparing a substrate coated with an X-ray transparent film, an X-ray absorber film and an etching mask film respectively thereon;

(b) etching said etching mask film so as to define a desired pattern;

(c) etching said X-ray absorber film by using said pattern of said etching mask film as a mask; and (d) removing said etching mask film, wherein the product of film stress and film thickness of said etching mask film is the range of 0 to $\pm 1\times 10^4$ dyn/cm.

12. An X-ray mask blank comprising:

(a) a substrate;

(b) an X-ray transparent film formed on said substrate;

(c) an etching stopper film having a high selective etching ratio for an X-ray absorber film formed thereon;

(d) the X-ray absorber film formed on said etching stopper film; and (e) an etching mask film formed on said X-ray absorber film for patterning said X-ray absorber film;

the product of film stress and film thickness of said etching stopper film and said etching mask film being in the range of 0 to $\pm 1\times 10^4$ dyn/cm.

13. A method for manufacturing an X-ray mask, said method comprising the steps of:

(a) preparing a substrate coated with an X-ray transparent film, an etching stopper film and an X-ray absorber film respectively thereon;

(b) etching said X-ray absorber film to have a desired pattern;

(c) removing the undesired portion of said etching stopper film, wherein the product of film stress and film thickness of said etching stopper film is the range of 0 to $\pm 1\times 10^4$ dyn/cm.

* * * * *